US008308491B2

(12) United States Patent
Nichols et al.

(10) Patent No.: US 8,308,491 B2
(45) Date of Patent: Nov. 13, 2012

(54) CONNECTOR ASSEMBLY HAVING A CABLE

(75) Inventors: Robert Paul Nichols, Santa Rosa, CA (US); Brian Patrick Costello, Scotts Valley, CA (US); Keith McQuilkin Murr, York, PA (US); Arash Behziz, Newbury Park, CA (US); Scott D. Spicer, Mechanicsburg, PA (US); Richard Elof Hamner, Hummelstown, PA (US); Jason M'Cheyne Reisinger, Carlisle, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 49 days.

(21) Appl. No.: 13/081,000

(22) Filed: Apr. 6, 2011

(65) Prior Publication Data

US 2012/0258612 A1 Oct. 11, 2012

(51) Int. Cl.
*H01R 12/00* (2006.01)

(52) U.S. Cl. ..... 439/67; 439/76.1

(58) Field of Classification Search ..... 439/67, 439/76.1, 77

See application file for complete search history.

(56) References Cited

U.S. PATENT DOCUMENTS

| | | | | |
|---|---|---|---|---|
| 4,087,146 | A * | 5/1978 | Hudson, Jr. | 439/67 |
| 5,080,609 | A * | 1/1992 | Fabian et al. | 439/541.5 |
| 5,383,787 | A * | 1/1995 | Switky et al. | 439/67 |
| 5,735,709 | A * | 4/1998 | Hashiguchi et al. | 439/495 |
| 5,971,773 | A * | 10/1999 | Riddle | 439/67 |
| 7,004,761 | B2 * | 2/2006 | Miyamura et al. | 439/67 |
| 7,144,256 | B2 * | 12/2006 | Pabst et al. | 439/67 |
| 7,399,192 | B2 * | 7/2008 | Yamamoto | 439/260 |
| 2006/0009051 | A1 * | 1/2006 | Schuylenbergh et al. | 439/67 |

* cited by examiner

*Primary Examiner* — Gary F. Paumen

(57) ABSTRACT

A connector assembly includes a connector housing configured to be coupled to a primary circuit board. A connector is held within the connector housing. The connector has a connector circuit board having a mating surface and a cable surface. The mating surface has mating contacts configured to be mated to corresponding mating contacts of a secondary circuit board. The cable surface has cable contacts. Cables extend between a first end and a second end. The first end of each cable is coupled to corresponding cable contacts of the connector circuit board. The second end of each cable is configured to be coupled to a cable contact on the primary circuit board or a second connector assembly on the primary circuit board.

20 Claims, 6 Drawing Sheets

CONNECTOR ASSEMBLY HAVING A CABLE

BACKGROUND OF THE INVENTION

The subject matter described herein relates to a connector assembly, and more particularly, to a connector assembly having a cable.

Some communication systems, such as servers, routers, and data storage systems, utilize connector assemblies for transmitting signals and/or power through the system. Such systems typically include a backplane or a midplane circuit board, a motherboard, and a plurality of daughter cards. The connector assemblies include one or more connectors that attach to the circuit boards or motherboard for interconnecting the daughter cards to the circuit boards or motherboard when the daughter card is inserted into the system. Each daughter card includes a header or receptacle assembly having a mating face that is configured to connect to a mating face of the connector. The header/receptacle assembly is typically positioned on or near a leading edge of the daughter card. Prior to being mated, the mating faces of the header/receptacle assembly and the connector are aligned with each other and face each other along a mating axis. The daughter card is then moved in an insertion direction along the mating axis until the mating faces engage and mate with each other.

The conventional backplane and midplane connector assemblies provide for interconnecting the daughter cards to the backplane or midplane circuit board. The connector assembly is electrically coupled to the backplane or midplane circuit board. Generally, the backplane or midplane circuit board includes a plurality of other connector assemblies, electrical components or modules coupled thereto. The connector assembly may be electrically coupled to one or more components or modules through signal traces extending through the backplane or midplane circuit board. In some communications systems, the connector assembly may be coupled to a second connector assembly through the signal traces.

However, known communications systems are not without their disadvantages. For example, the signal traces extending from the connector assemblies may extend a substantial distance along the backplane or midplane circuit board. Typically, longer signal traces may experience signal losses between the connector assembly and the component, module, or second connector assembly. Accordingly, the communication system may not operate at a desired speed and/or may become inoperable.

A need remains for a connector assembly that prevents signal loss between the connector assembly and the component, module, or second connector.

SUMMARY OF THE INVENTION

In one embodiment, a connector assembly is provided. The connector assembly includes a connector housing configured to be coupled to a primary circuit board. A connector is held within the connector housing. The connector has a connector circuit board having a mating surface and a cable surface. The mating surface has mating contacts configured to be mated to corresponding mating contacts of a secondary circuit board. The cable surface has cable contacts. The connector assembly also includes cables extending between a first end and a second end. The first end of each cable is coupled to corresponding cable contacts of the connector circuit board. The second end of each cable is configured to be coupled to a cable contact on the primary circuit board or a second connector assembly on the primary circuit board.

In another embodiment, an electrical system is provided. The electrical system includes a primary circuit board. A connector housing is coupled to the primary circuit board. A connector is held within the connector housing. The connector has a connector circuit board having a mating surface and a cable surface. The mating surface has mating contacts. The cable surface has cable contacts. A secondary circuit board is provided having mating contacts mated to corresponding mating contacts of the connector circuit board. Cables extending between a first end and a second end. The first end of each cable is coupled to corresponding cable contacts of the connector circuit board. The second end of each cable is coupled to a cable contact on the primary circuit board or a second connector assembly on the primary circuit board.

BRIEF DESCRIPTION OF THE DRAWINGS

The presently disclosed subject matter will be better understood from reading the following description of non-limiting embodiments, with reference to the attached drawings, wherein below.

DETAILED DESCRIPTION OF THE INVENTION

The foregoing summary, as well as the following detailed description of certain embodiments will be better understood when read in conjunction with the appended drawings. As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Various embodiments provide an electrical system having a connector coupled to a primary circuit board. The connector includes a connector circuit board having a mating surface and a cable surface. A secondary circuit board is coupled to the mating surface of the connector circuit board. Cables extend from the cable surface of the connector circuit board to at least one of the primary circuit board or a second connector positioned on the primary circuit board to electrically couple the secondary circuit board to at least one of the primary circuit board or the second connector. The cables eliminate traces extending through the primary circuit board. Accordingly, signal losses that are generally experienced through the traces are reduced.

Figure 1:
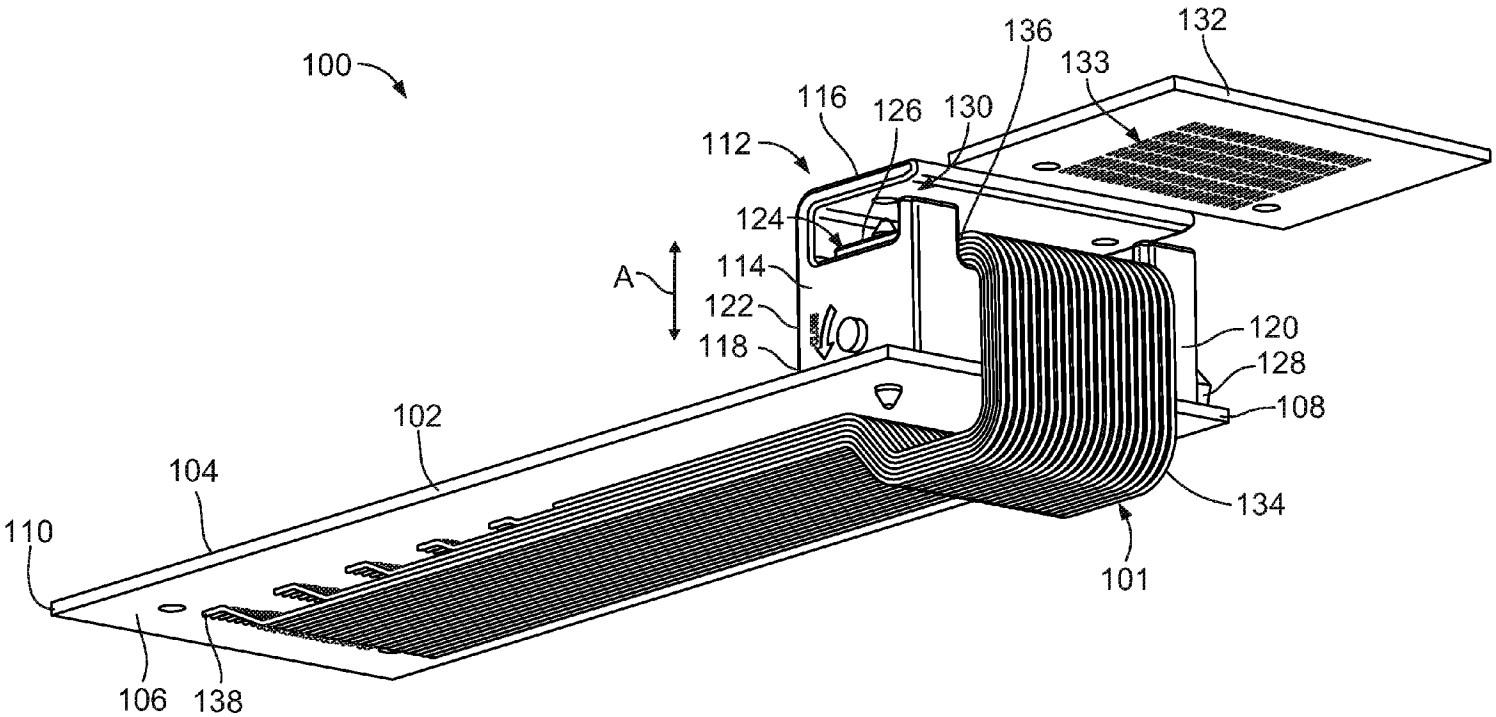
FIG. 1 is a perspective view of an electrical system formed in accordance with an embodiment.

FIG. 1 is a perspective view of an electrical system 100 formed in accordance with an embodiment. The electrical system 100 includes a cable assembly 101 that interconnects various electrical components, such as circuit boards, electrical connectors, such as high density side interface connectors, integrated circuit (IC) components, such as an electronic package in the form of a chip or other circuitized module, or other types of electrical components. In the illustrated embodiment, the cable assembly 101 is used to interconnect a primary circuit board 102 and a secondary circuit board 132. The cable assembly 101 eliminates signal traces in the primary circuit board 102 along a significant length of the signal path between the primary and secondary circuit boards 102, 132 to reduce signal losses along the signal path as compared to systems that do not utilize a cable assembly.

In an exemplary embodiment, the electrical system 100 is a network switch or server system. The primary circuit board 102 may be a motherboard, a backplane circuit board, a midplane circuit board, and the like. The secondary circuit board 132 may be a daughtercard or a switch or line card and the like. The secondary circuit board may be a removable card that is removably coupled within the electrical system 100.

The primary circuit board 102 has a mating surface 104 and an opposite cable surface 106. The primary circuit board 102 includes a first end 108 and a second end 110. The mating surface 104 and the cable surface 106 extend between the first end 108 and the second end 110. The primary circuit board 102 may be secured in a cabinet or rack of the server system or network switch.

In an exemplary embodiment, the electrical system 100 includes a connector assembly 112 for interfacing between the primary and secondary circuit boards 102, 132. The secondary circuit board 132 is configured to be removably coupled to the connector assembly 112. The cable assembly 101 is electrically coupled to the connector assembly 112 for transmitting signals between the secondary circuit board 132 and the primary circuit board 102.

The connector assembly 112 is mounted to the primary circuit board 102 at the first end 108 of the primary circuit board 102. Alternatively, the connector assembly 112 may be positioned at the second end 110 of the primary circuit board 102. The connector assembly 112 may be positioned at an intermediate location between the first end 108 and the second end 110 of the primary circuit board 102 in alternative embodiments. The connector assembly 112 is coupled to the mating surface 104 of the primary circuit board 102. Alternatively, the connector assembly 112 may be coupled to the cable surface 106 of the primary circuit board 102. The connector assembly 112 may be press-fit, soldered, latched, secured by fasteners or otherwise coupled to the primary circuit board 102.

The connector assembly 112 includes a connector housing 114. The connector housing 114 includes a top 116 and a bottom 118. A front end 120 and a rear end 122 extend between the top 116 and the bottom 118. The bottom 118 of the connector housing 114 is coupled to the primary circuit board 102. The front end 120 of the connector housing 114 is positioned proximate to the first end 108 of the primary circuit board 102. In one embodiment, the front end 120 of the connector housing 114 may be flush with the first end 108 of the primary circuit board 102.

The connector assembly 112 includes an interconnect assembly 124 used to interconnect the secondary circuit board 132 and the cable assembly 101. The interconnect assembly 124 is held within the connector housing 114. The interconnect assembly 124 is movable within the connector housing 114 for mating with the secondary circuit board 132. Optionally, the interconnect assembly 124 may be positioned proximate to the top 116 of the connector housing 114.

In an exemplary embodiment, the connector housing 114 includes a slot 130 open at the front end 120. The slot 130 is positioned between the interconnect assembly 124 and the top 116 of the connector housing 114. The secondary circuit board 132 is configured to be received in the slot 130.

The interconnect assembly 124 includes a separable mating face 126. The mating face 126 is configured to engage the secondary circuit board 132 to electrically connect the interconnect assembly 124 and the secondary circuit board 132.

The interconnect assembly 124 is configured to move between an engaged position and a disengaged position to engage and disengage from, respectively, the secondary circuit board 132. In the illustrated embodiment, the interconnect assembly 124 is movable in a direction, shown by arrow A, generally perpendicular to the bottom 118 and the top 116 of the connector housing 114 between the engaged and disengaged positions. The interconnect assembly 124 is movable toward the top 116 as the interconnect assembly 124 is moved to the engaged position. The interconnect assembly 124 is movable toward the bottom 118 as the interconnect assembly 124 is moved to the disengaged position. In an alternative embodiment, rather than moving in a linear direction, the interconnect assembly may be rotated between the engaged and disengaged positions.

In an exemplary embodiment, the connector assembly 112 includes an actuator 128 that may be manipulated to move the interconnect assembly 124 within the connector housing 114. Optionally, the actuator 128 may be a mechanical actuator, such as a cam assembly or a lever assembly, that engages the interconnect assembly 124 to move the actuator assembly 124 between the engaged and disengaged positions. The interconnect assembly 124 is moved within the connector housing 114 to change a size of the slot 130. As the interconnect assembly 124 is actuated, the interconnect assembly 124 is moved closer to the secondary circuit board 132 to engage the secondary circuit board 132. The actuator 128 may press the mating face 126 of the interconnect assembly 124 against the secondary circuit board 132 to electrically connect the interconnect assembly 124 and the secondary circuit board 132.

The secondary circuit board 132 includes an array of mating contacts 133 positioned on a mating surface of the secondary circuit board 132. The secondary circuit board 132 is received in the slot 130 such that the array of mating contacts 133 faces the interconnect assembly 124. The interconnect assembly 124 is moved toward the secondary circuit board 132 by the actuator 128 to engage the secondary circuit board 132. The mating contacts 133 of the secondary circuit board 132 are electrically coupled to the interconnect assembly 124 in the engaged position. The mating contacts 133 may be any type of contacts, such as contact pads, spring contacts, pins, sockets, solder balls, and the like. In an exemplary embodiment, the mating contacts 133 are configured to define a separable interface, where the mating contacts 133 may be readily mated and unmated with the interconnect assembly 124.

In an exemplary embodiment, the interconnect assembly 124 includes a substrate, such as the connector circuit board 174 (shown in FIG. 7), that defines the mating face 126. The interconnect assembly 124 includes an array of contacts 131 (shown in FIG. 8) along the mating face 126 that are configured to mate with the mating contacts 133 of the secondary circuit board 132. The contacts 131 may be any type of contacts, such as contact pads, spring contacts, pins, sockets, solder balls, and the like. In an exemplary embodiment, the contacts 131 are configured to define a separable interface, where the contacts 131 may be readily mated and unmated with the mating contacts 133 of the secondary circuit board 132. The array of contacts 131 are also configured to be electrically connected to the cable assembly 101, such as through the substrate or connector circuit board 174.

The cable assembly 101 includes a plurality of cables 134 that are configured to be electrically connected to the interconnect assembly 124. The cables 134 may be electrically connected to corresponding contacts 131, such as through the connector circuit board 174 of the interconnect assembly 124. The cables 134 may be terminated to an opposite side of the connector circuit board 174 from the mating face 126, such as to a cable side of the connector circuit board 174. The cables 134 extend from the interconnect assembly 124 to a location of the electrical system 100 remote from the interconnect assembly 124. For example, the cables 134 may extend from the interconnect assembly 124 to a distant location of the primary circuit board 102, where the cables 134 are terminated to the primary circuit board 102 or another electronic component, such as a second connector assembly. In an exemplary embodiment, the cables 134 are coaxial cables having a center conductor surrounded by a shield or cable braid that provides electrical shielding for the center conductor. In other exemplary embodiments, the cables 134 are twin axial cables having two center conductors surrounded by a shield or cable braid. The twin axial cables may be used in short-range high-speed differential signaling applications.

In an exemplary embodiment, the cables 134 are routed from the front end 120 of the connector housing 114 to the cable surface 106 of the primary circuit board 102. The cables 134 wrap around the front edge of the primary circuit board 102 to the cable surface 106, which is the surface of the primary circuit board 102 opposite to where the connector assembly 112 is mounted. Each cable 134 includes a first end 136 that is coupled to the connector circuit board 174 of the interconnect assembly 124 and a second end 138 opposite the first end 136. In the illustrated embodiment, the second end 138 of the cable 134 is terminated to contacts or pads on the cable surface 106 of the primary circuit board 102 remote from the connector assembly 112. In alternative embodiments, the second end 138 of the cable 134 may be terminated to another electronic component, such as a second connector assembly 112. Optionally, the first and second ends 136, 138 may be directly terminated to the connector circuit board 174 of the interconnect assembly 124 and the primary circuit board 102, respectively. Alternatively, terminals or contacts may be terminated to the first and/or second ends 136, 138 for electrical connection to the connector circuit board 174 of the interconnect assembly 124 and the primary circuit board 102, respectively The cables 134 electrically couple the interconnect assembly 124 to the primary circuit board 102. The cables 134 electrically couple the secondary circuit board 132 to the primary circuit board 102. The cables 134 eliminate signal traces in the primary circuit board 102 to reduce signal losses between the primary circuit board 102 and the secondary circuit board 132. For example, a signal trace in the primary circuit board 102 is eliminated from the location of the connector assembly 112 to the location at which the cable 134 is terminated to the primary circuit board 102, which could be a considerable portion of the total signal path length. Additionally, the primary circuit board 102 may be manufactured with fewer layers as significant portions of the signal traces are removed.

It should be noted that although the cables 134 are illustrated as extending along and coupling to the cable surface 106 of the primary circuit board 102, the cables 134 may also or exclusively extend along and couple to the mating surface 104 of the primary circuit board 102 in alternative embodiments.

Figure 2:
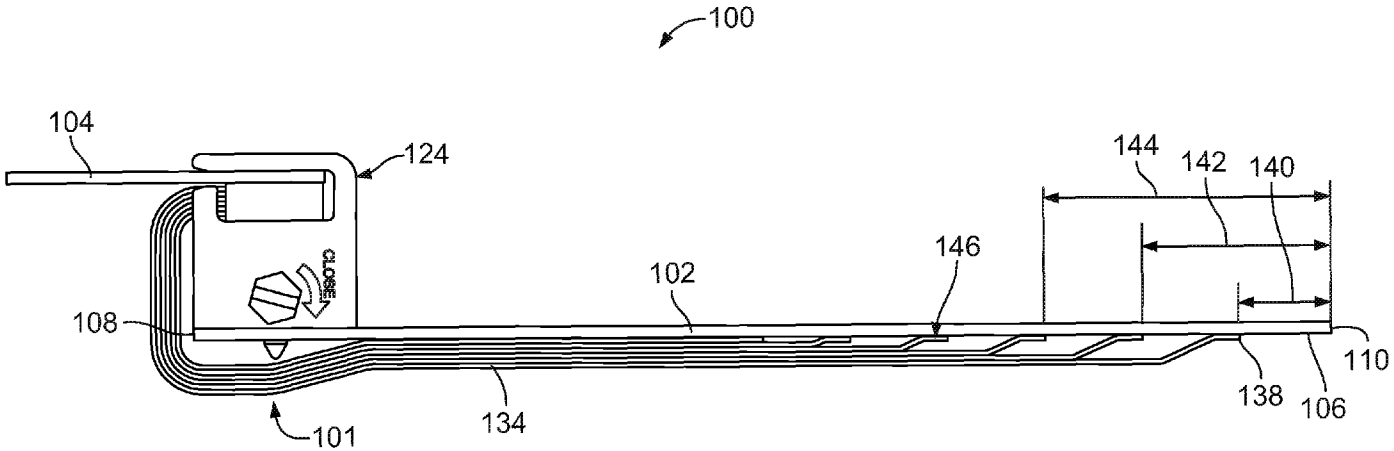
FIG. 2 is a side view of the electrical system shown in FIG. 1.

FIG. 2 is a side view of the electrical system 100 showing the cable assembly 101 terminated thereto. FIG. 2 illustrates the secondary circuit board 104 received in, and mated to, the interconnect assembly 124. FIG. 2 illustrates a plurality of cables 134 terminated to the primary circuit board 102. The cables 134 extend along the cable surface 106 of the primary circuit board 102. The second ends 138 of the cables 134 are terminated at different longitudinal locations along the cable surface 106 of the primary circuit board 102. For example, one cable 134 may be terminated at a first distance 140 from the second end 110 of the primary circuit board 102, while another cable 134 is terminated at a second distance 142 from the second end 110 that is greater than the first distance 140, and another cable 134 is terminated at a third distance 144 from the second end 110 that is greater than the second distance 142, and so on. The cables 134 are terminated at termination locations 146.

It should be noted that the cables 134 may terminate at any location along the cable surface 106 of the primary circuit board 102. It should also be noted that several cables 134 may terminate at the same longitudinal position between the first end 108 (shown in FIG. 1) and the second end 110 of the primary circuit board 102 but at a different lateral position. For example, FIG. 2 illustrates one row of termination locations 146 with multiple cables 134 terminated in such row. The cable assembly 101 may have other cables 134 forming other rows.

Figure 3:
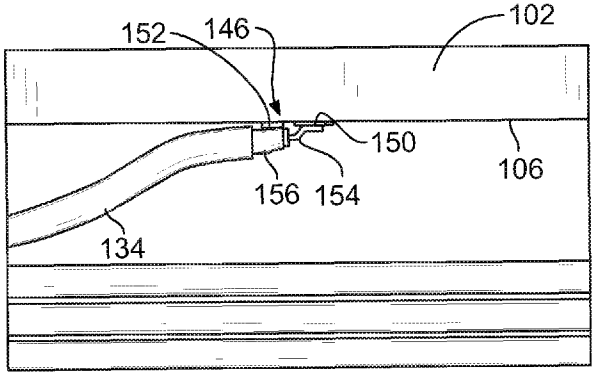
FIG. 3 is an exploded side view of a portion of the primary circuit board shown in FIG. 2.

FIG. 3 is an exploded side view of a portion of the primary circuit board 102 illustrated in area 3 of FIG. 2. The primary circuit board 102 includes an array of contacts, such as contact pads, on the cable surface 106. The contact pads may be signal pads, ground pads and/or power pads. In the illustrated embodiment, the cables 134 transmit data signals, and the array of contacts includes both signal pads and ground pads. For example, FIG. 3 illustrates a cable contact 150 and a ground contact 152 positioned on the cable surface 106 of the primary circuit board 102.

In the illustrated embodiment, the cable contact 150 and the ground contact 152 are solder pads on the cable surface 106 of the primary circuit board 102. However, in alternative embodiments, the cable contact 150 and the ground contact 152 may be other types of contacts, such as pins, sockets, insulation displacement contacts, poke-in wire contacts, or other types of contacts that allow the cables 134 to be terminated at the termination locations 146.

The cable 134 includes a center conductor 154 and a cable shield 156. The center conductor 154 of the cable 134 is soldered or otherwise adhered to the cable contact 150. The cable shield 156 of the cable 134 is soldered or otherwise adhered to the ground contact 152. The cable contact 150 and the ground contact 152 provide an electrical connection between the cable 134 and the primary circuit board 102. It should be noted that in alternative embodiments other coupling mechanisms may be utilized to electrically couple the cable 134 to the primary circuit board 102, such as a contact or connector terminated to the end of the cable 134.

In an exemplary embodiment, the cable 134 may be a twin axial cable having two center conductors 154. A pair of cable contacts 150 may be arranged adjacent one another as differential pairs of contacts. Both center conductors 154 may be terminated to the corresponding cable contacts 150.

Figure 4:
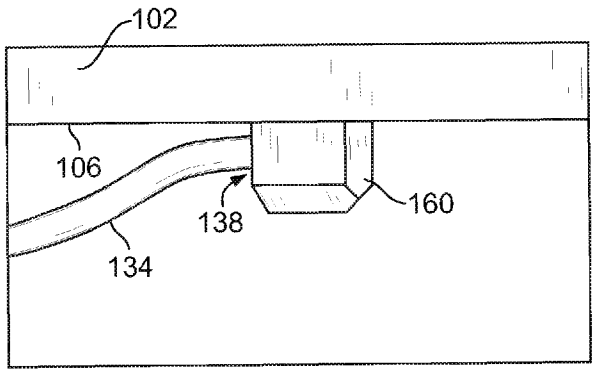
FIG. 4 is an exploded side view of a portion of the primary circuit board shown in FIG. 2 and having a cable connector coupled thereto.

FIG. 4 illustrates another connection method for terminating the cable 134 to the primary circuit board shown 102. A cable connector 160 is terminated to the second end 138. For example, the cable connector 160 may be crimped or soldered to the second end 138. The cable connector 160 is coupled to the primary circuit board 102, such as by pressing the cable connector 160 into a corresponding via of the primary circuit board 102. The cable connector 160 may provide electromagnetic shielding for the cable 134 as well as impedance matching for the center conductor/differential pair.

Figure 5:
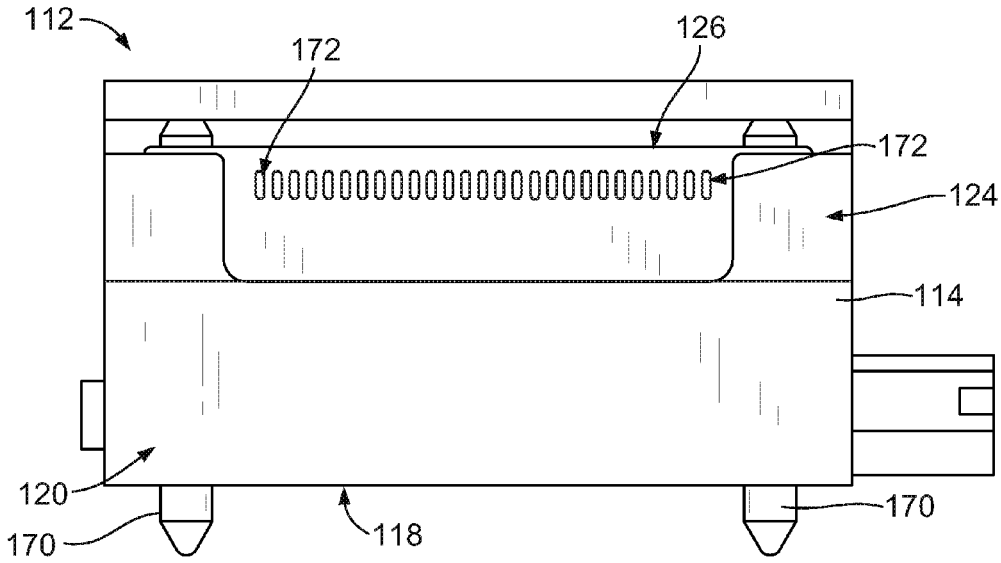
FIG. 5 is a front view of a connector assembly formed in accordance with an embodiment.

FIG. 5 is a front view of the connector assembly 112. FIG. 5 illustrates the front end 120 of the connector housing 114. The bottom 118 of the connector housing 114 includes pins 170 extending therefrom. The pins 170 are configured to be inserted into apertures (not shown) formed in the mating surface 104 of the primary circuit board 102 (both shown in FIG. 1). The pins 170 are used to orient the connector housing 114 with respect to the primary circuit board 102. Optionally, the pins 170 may form an interference fit with the apertures to secure the connector assembly 112 to the mating surface 104 of the primary circuit board 102. The connector assembly 112 may be coupled to the primary circuit board 102 using other suitable coupling mechanisms in alternative embodiments.

A front 127 of the interconnect assembly 124 includes a plurality of apertures 172 formed therein. The cables 134 (shown in FIG. 1) extend through the apertures 172. The first ends 136 of the cables 134 may be inserted into the apertures 172 and coupled to a substrate or connector circuit board 174 (shown in FIG. 7) of the interconnect assembly 124.

Figure 6:
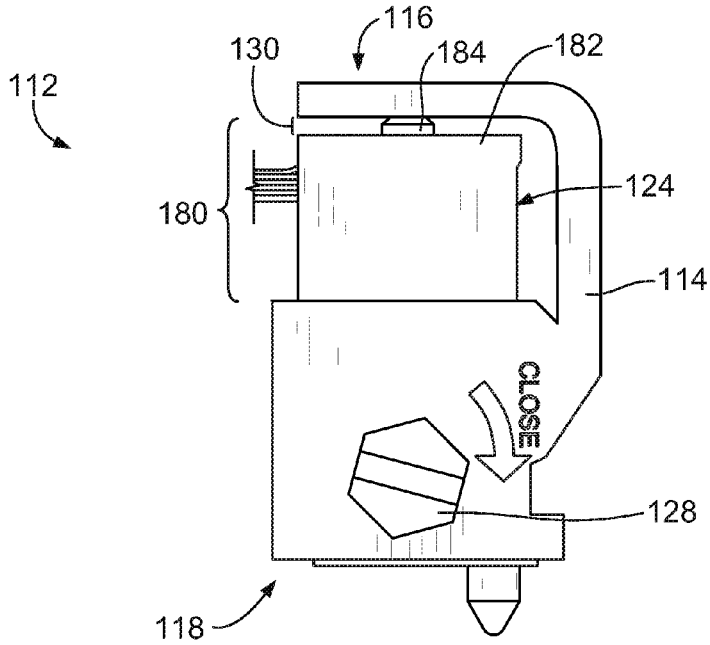
FIG. 6 is a side view of the connector assembly shown in FIG. 5.

FIG. 6 is a side view of the connector assembly 112. A space 180 is formed between the top 116 and the bottom 118 of the connector housing 114. The interconnect assembly 124 is positioned within the space 180 such that the gap 130 is defined between the interconnect assembly 124 and a wall of the connector housing 114 at the top 116. The interconnect assembly 124 is configured to be movable between the engaged and disengaged positions (e.g. up and down) within the space 180. The actuator 128 is manipulated to move the interconnect assembly 124. A vertical height of the gap 130 is increased or decreased as the interconnect assembly 124 is moved in the connector housing 114.

In an exemplary embodiment, the interconnect assembly 124 includes a top 182 with one or more locating features 184 extending from the top 182 that locate the secondary circuit board 132 (shown in FIG. 1) with respect to the interconnect assembly 124. The locating feature 184 may be a pin that is loaded into an aperture in the secondary circuit board to secure the secondary circuit board 132 within the connector housing 114. The locating feature 184 may be part of the interconnect assembly 124, such that as the interconnect assembly 124 is moved upward toward the top 116 of the connector housing 114, the locating feature 184 is received in the aperture to secure the secondary circuit board 132 within the connector housing 114.

Figure 7:
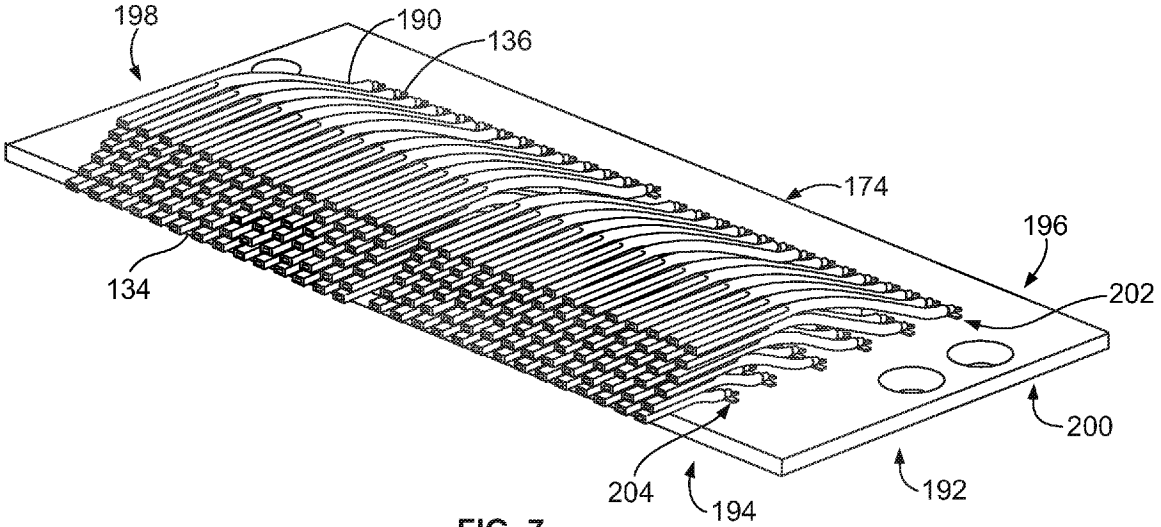
FIG. 7 is a bottom perspective view of a connector circuit board formed in accordance with an embodiment.

FIG. 7 is a bottom perspective view of the connector circuit board 174 formed in accordance with an exemplary embodiment. The connector circuit board 174 is part of the interconnect assembly 124 (shown in FIG. 6). The connector circuit board 174 includes a cable surface 190 and an opposite mating surface 192. Optionally, the mating surface 192 may define the mating face 126 (shown in FIG. 6) of the interconnect assembly 124. The connector circuit board 174 includes a front end 194 and a back end 196. The connector circuit board 174 includes a first side 198 and a second side 200.

The connector circuit board 174 is positioned within the interconnect assembly 124. The connector circuit board 174 is positioned at the top 182 (shown in FIG. 6) of the interconnect assembly 124. The connector circuit board 174 is positioned within the interconnect assembly 124 so that the mating surface 192 of the connector circuit board 174 engages the secondary circuit board 132 (shown in FIG. 1) when the interconnect assembly 124 is moved upward to engage the secondary circuit board 132. The connector circuit board 174 forms an electrical connection with the secondary circuit board 132. The mating surface 192 of the connector circuit board 174 forms an electrical connection with the secondary circuit board 132. In an exemplary embodiment, the mating surface 192 includes the array of contacts 131 (shown in FIG. 1) that define a separable mating interface for mating with the secondary circuit board 132. The connector circuit board 174 may include vias or other conductors that connect the array of contacts 131 with an array of contacts 204 on the cable surface 190. The array of contacts 204 are configured to be electrically connected to the cables 134.

The first ends 136 of the cables 134 are coupled to the contacts 204 at the cable surface 190 of the connector circuit board 174. The first ends 136 of the cables 134 are coupled to the contacts 204 at various intermediate locations between the front end 194 and the back end 196 of the connector circuit board 174. The first ends 136 of the cables 134 may be arranged in rows 202 extending between the first side 198 and the second side 200 of the connector circuit board 174.

Figure 8:
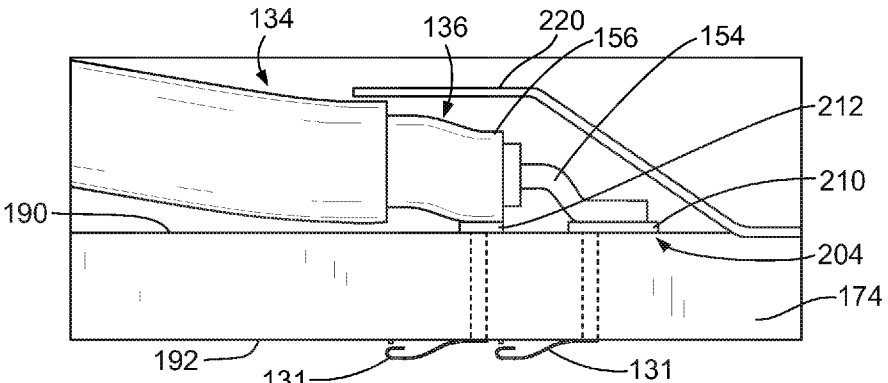
FIG. 8 is an exploded side view of a portion of the connector circuit board shown in FIG. 7.

FIG. 8 is a side view of a portion of the connector circuit board 174 showing one of the cables 134 terminated to the connector circuit board 174. The array of contacts 204 may include different types of contacts, such as signal contacts, ground contacts and/or power contacts. In the illustrated embodiment, the contacts include a cable contact 210 and a ground contact 212 provided on the cable surface 190 of the connector circuit board 174. In the illustrated embodiment, the cable contact 210 and the ground contact 212 are contact pads provided on the cable surface 190. The cable and ground contacts 210, 212 may be other types of contacts in alternative embodiments, such as pins, sockets, plated vias, insulation displacement contacts, poke-in wire contacts, and the like. The cable and ground contacts 210, 212 are electrically connected to corresponding contacts 131 on the mating surface 192, such as through plated vias or other types of traces or conductors through the connector circuit board 174.

The cable 134 includes the center conductor 154 and the shield 156. The center conductor 154 of the cable 134 is soldered or otherwise adhered to the cable contact 210. The shield 156 of the cable 134 is soldered or otherwise adhered to the ground contact 212. The cable contact 210 and the ground contact 212 provide an electrical connection between the cable 134 and the connector circuit board 174. It should be noted that in alternative embodiments other coupling mechanisms may be utilized to electrically couple the cable 134 to the connector circuit board 174.

In an exemplary embodiment, a shield 220 is positioned over the first end 136 of the cable 134. The shield 220 is formed as a hood or shroud extending over the first end 136. The shield 220 provides electromagnetic shielding for the cable 134 as well as aiding in impedance matching of the center conductor/differential pair. The shape and/or positioning of the shield 220 to the cable 134 may be controlled to control the impedance. The shield 220 is mounted to the connector circuit board 174. Optionally, the shield 220 may be electrically connected to a ground layer of the connector circuit board 174 to electrically ground the shield 220.

Figure 9:
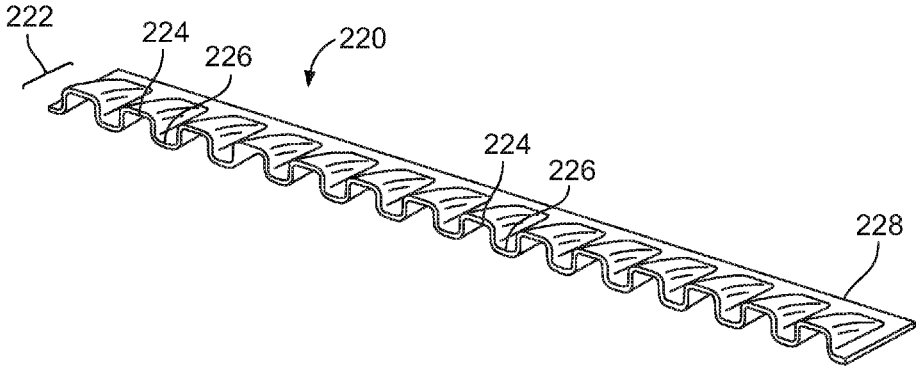
FIG. 9 is a top perspective view of a shield formed in accordance with an embodiment.

FIG. 9 is a top perspective view of the shield 220 formed in accordance with an embodiment. The shield 220 is formed with a saw-tooth edge 222 and a flat edge 228. The edge 222 includes a plurality of peaks 224 and valleys 226. The peaks 224 are positioned between adjacent valleys 226. The valleys 226 are positioned between adjacent peaks 224. The shield 220 is configured to be positioned over a row of the cables 134 (as illustrated in FIG. 7). The first end 136 (shown in FIG. 7) of each cable 134 is configured to be positioned within a peak 224 of the shield 220. The shields 220 may have alternative shapes in alternative embodiments. In an alternative embodiment, the shield 220 may be an individual shield configured to shield only one cable 134.

Figure 10:
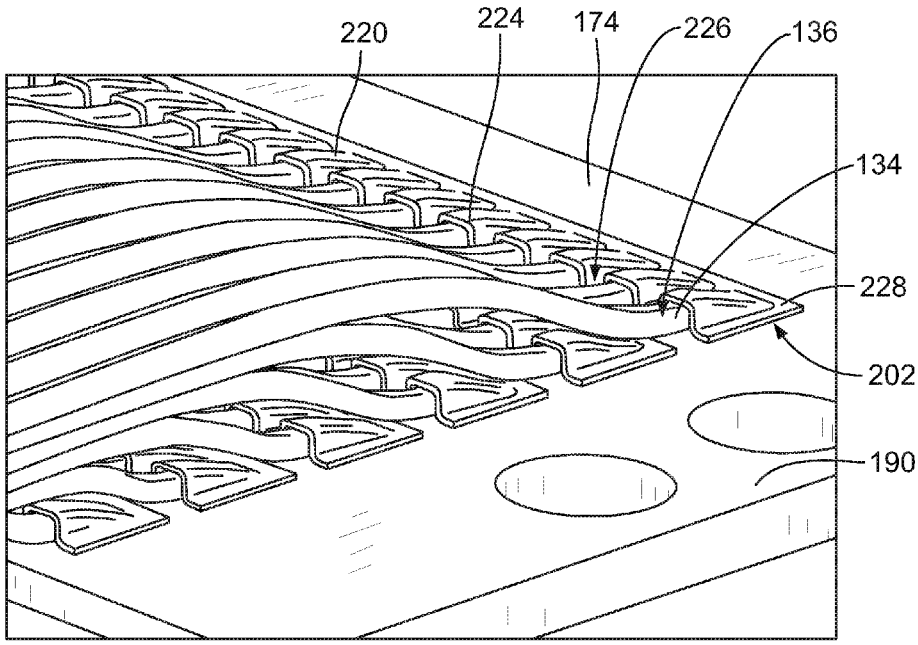
FIG. 10 is a bottom perspective view of a portion of the connector circuit board shown in FIG. 7 and having the shield shown in FIG. 9 coupled thereto.

FIG. 10 is a bottom perspective view of a portion of the connector circuit board 174 having shields 220 coupled thereto. The connector circuit board 174 has a plurality of rows 202 of cables 134. Each row 202 has a shield 220 positioned over the first ends 136 of the cables 134. The first ends 136 of the cables 134 are positioned within the peaks 224 of the shield. The valleys 226 of the shield 220 abut the cable surface 190 of the connector circuit board 174. The valleys 226 of the shield 220 may be soldered, adhered, or otherwise coupled to the connector circuit board 174. In one embodiment, the flat edge 228 of the shield 220 is soldered, adhered, or otherwise coupled to the connector circuit board 174. The shield 220 provides electromagnetic shielding for the cables 134 as well as impedance matching for the conductor/differential pair. It should be noted that in one embodiment, the shield 220 may be positioned over rows of second ends 138 (shown in FIG. 2) of cables 134. In such an embodiment, the shield 220 may be coupled to the primary circuit board 102 (shown in FIG. 2).

Figure 11:
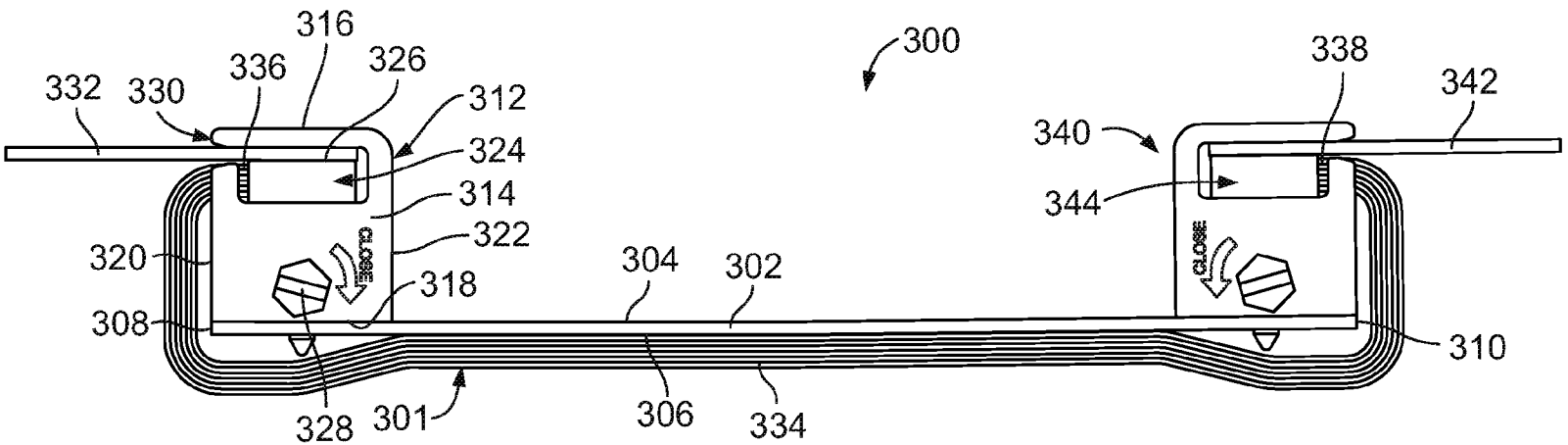
FIG. 11 is a side view of an electrical system formed in accordance with an embodiment.

FIG. 11 is a side view of an electrical system 300 formed in accordance with an exemplary embodiment. The electrical system 300 includes a primary circuit board 302 having a mating surface 304 and an opposite cable surface 306. In one embodiment, the primary circuit board 302 may be a backplane or a midplane circuit board, a motherboard, or the like. The primary circuit board 302 includes a first end 308 and a second end 310. The mating surface 304 and the cable surface 306 extend between the first end 308 and the second end 310. In an alternative embodiment, rather the a circuit board, the primary circuit board may be replaced by a substrate, sheet, block or other structure without circuits or traces that is used to support other components of the electrical system 300.

A connector assembly 312 is positioned at the first end 308 of the primary circuit board 302. A second connector assembly 340 is positioned at the second end 310 of the primary circuit board 302. The connector assemblies 312 and 340 are coupled to the mating surface 304 of the primary circuit board 302. Optionally, the connector assemblies 312 and 340 may be coupled to the cable surface 306 of the primary circuit board 302. The connector assemblies 312 and 340 may be press-fit, soldered, or otherwise coupled to the primary circuit board 302. The connector assemblies 312, 340 may be substantially similar to the connector assembly 112 (shown in FIG. 1).

The connector assembly 312 includes a connector housing 314. The connector housing 314 includes a top 316 and a bottom 318. A front end 220 and a rear end 322 extend between the top 316 and the bottom 318. The bottom 318 of the connector housing 314 is coupled to the primary circuit board 302. The front end 320 of the connector housing 314 is positioned proximate to the first end 308 of the primary circuit board 302. In one embodiment, the front end 320 of the connector housing 314 may be flush with the first end 308 of the primary circuit board 302.

An interconnect assembly 324 is positioned proximate to the top 316 of the connector housing 314. A slot 330 is formed between the interconnect assembly 324 and the top 316 of the connector housing 314. The interconnect assembly 324 includes a mating face 326. The interconnect assembly 324 is configured to move between the bottom 318 and the top 316 of the connector housing 314. The connector assembly 312 includes an actuator 328 that may be manipulated to move the interconnect assembly 324 within the connector housing 314.

A secondary circuit board 332 is positioned within the slot 330. The secondary circuit board 332 may be a daughter card or the like. The interconnect assembly 324 is moved toward the top 316 of the connector housing 314 to engage the secondary circuit board 332. The secondary circuit board 332 is electrically coupled to the interconnect assembly 324 when in the engaged position.

The connector assembly 340 is configured to be mated to a secondary circuit board 342. The connector assembly 340 includes an interconnect assembly 344 that makes electrical connection with the secondary circuit board 342. The interconnect assembly 344 is movable between an engaged position and a disengaged position. The interconnect assembly 344 has a separable mating interface for mating with the secondary circuit board 342.

The electrical system 300 includes a cable assembly 301 that interconnects the connector assemblies 312, 340 with one another and/or with the primary circuit board 302. The cable assembly 301 includes a plurality of cables 334. The cables 334 are terminated to the interconnect assembly 324. The cables 334 are terminated to the interconnect assembly 344.

In an exemplary embodiment, each cable 334 includes a first end 336 that is terminated to the mating face 326 of the interconnect assembly 324 and a second end 338 that is terminated to the interconnect assembly 344. The cable 334 extends along the cable surface 306 of the primary circuit board 302. The cable 334 electrically couples the connector assembly 312 to the second connector assembly 340. The cable 334 electrically couples the secondary circuit board 332 to the secondary circuit board 342. The cable 334 eliminates signal traces in the primary circuit board 302 to reduce signal losses between the connector assembly 312 and the second connector assembly 340.

In an alternative embodiment, the second ends 338 of at least some of the cables 334 may be terminated to the primary circuit board 302 at various terminating locations. Other cables 334 may be terminated at one end to the second connector assembly 340 and at the other end to the primary circuit board 302. The primary circuit board 302 may electrically connect certain ones of the cables 334 together to control the signal paths through the electrical system 300.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the invention without departing from their scope. While the dimensions and types of materials described herein are intended to define the parameters of the various embodiments of the invention, the embodiments are by no means limiting and are exemplary embodiments. Many other embodiments will be apparent to those of skill in the art upon reviewing the above description. The scope of the various embodiments of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose the various embodiments of the invention, including the best mode, and also to enable any person skilled in the art to practice the various embodiments of the invention, including making and using any devices or systems and performing any incorporated methods. The patentable scope of the various embodiments of the invention is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal languages of the claims.

What is claimed is:

1. A connector assembly comprising:

a connector housing configured to be coupled to a primary circuit board;

a connector held within the connector housing, the connector having a connector circuit board having a mating surface and a cable surface, the mating surface having mating contacts configured to be mated to corresponding mating contacts of a secondary circuit board, the cable surface having cable contacts; and cables extending between a first end and a second end, the first end of each cable coupled to corresponding cable contacts of the connector circuit board, the second end of each cable configured to be coupled to a cable contact on the primary circuit board or a second connector assembly on the primary circuit board.

2. The connector assembly of claim 1, wherein the cables are coaxial cables having a center conductor and a cable shield surrounding the center conductor, the cable shield being grounded to the connector circuit board and being configured to ground to the primary circuit board.

3. The connector assembly of claim 1, wherein the cable contacts of the primary circuit board are arranged in differential pairs, the cables being twin axial cables mated to the differential pairs.

4. The connector assembly of claim 1, wherein the connector is moveable within the connector housing to mate the connector circuit board mating surface to the secondary circuit board.

5. The connector assembly of claim 1, wherein the connector includes apertures to receive the cables.

6. The connector assembly of claim 1, wherein the connector housing is configured to be mounted to a first end of the primary circuit board, the cables configured to extend along the primary circuit board to a location remote from the first end of the primary circuit board.

7. The connector assembly of claim 1, wherein the connector housing is configured to be mounted to a first end of the primary circuit board, the second connector assembly mounted on a second end of the primary circuit board.

8. The connector assembly of claim 1, wherein the connector housing includes a slot configured to receive the secondary circuit board.

9. The connector assembly of claim 1, wherein the cables have different lengths to attach to the primary circuit board at different locations between a first end and a second end of the primary circuit board.

10. The connector assembly of claim 1 further comprising shields positioned over at least one of the first end and the second end of the cables.

11. An electrical system comprising:

a primary circuit board;

a connector housing coupled to the primary circuit board;

a connector held within the connector housing, the connector having a connector circuit board having a mating surface and a cable surface, the mating surface having mating contacts, the cable surface having cable contacts;

a secondary circuit board having mating contacts mated to corresponding mating contacts of the connector circuit board; and cables extending between a first end and a second end, the first end of each cable coupled to corresponding cable contacts of the connector circuit board, the second end of each cable coupled to a cable contact on the primary circuit board or a second connector assembly on the primary circuit board.

12. The electrical system of claim 11, wherein the cables are coaxial cables having a center conductor and a cable shield surrounding the center conductor, the cable shield being grounded to the connector circuit board and the primary circuit board.

13. The electrical system of claim 11, wherein the cable contacts of the primary circuit board are arranged in differential pairs, the cables being twin axial cables mated to the differential pairs.

14. The electrical system of claim 11, wherein the connector is moveable within the connector housing to mate the connector circuit board mating surface to the secondary circuit board.

15. The electrical system of claim 11, wherein the connector includes apertures to receive the cables.

16. The electrical system of claim 11, wherein the connector housing is mounted to a first end of the primary circuit board, the cables extending along the primary circuit board to a location remote from the first end of the primary circuit board.

17. The electrical system of claim 11, wherein the connector housing is mounted to a first end of the primary circuit board, the second connector assembly mounted on a second end of the primary circuit board.

18. The electrical system of claim 11, wherein the connector housing includes a slot to receive the secondary circuit board.

19. The electrical system of claim 11, wherein the cables have different lengths to attach to the primary circuit board at different locations between a first end and a second end of the primary circuit board.

20. The electrical system of claim 11 further comprising shields positioned over at least one of the first end and the second end of the cables.

* * * * *